US006640447B2

(12) United States Patent
Wickline

(10) Patent No.: US 6,640,447 B2
(45) Date of Patent: Nov. 4, 2003

(54) DEAD-BLOW RECOILLESS AXE

(76) Inventor: Kenneth K. Wickline, 22449 West Rd., #202, Woodhaven, MI (US) 48183

( * ) Notice: Subject to any disclaimer, the term of this patent is extended or adjusted under 35 U.S.C. 154(b) by 0 days.

(21) Appl. No.: 10/023,015

(22) Filed: Dec. 18, 2001

(65) Prior Publication Data

US 2003/0110643 A1 Jun. 19, 2003

(51) Int. Cl.[7] ..... B26B 23/00
(52) U.S. Cl. ..... 30/308.1
(58) Field of Search ..... 30/308.1, 318; D8/76; 81/22

(56) References Cited

U.S. PATENT DOCUMENTS

| | | | | |
|---|---|---|---|---|
| 115,532 A | | 5/1871 | Sears | 30/308.1 |
| 479,032 A | | 7/1892 | Surbaugh | 81/22 |
| 561,000 A | | 5/1896 | Karns | 30/308.1 |
| 690,940 A | | 1/1902 | Febiger | 473/333 |
| 1,045,145 A | | 11/1912 | Hubbard | 81/22 |
| 2,377,157 A | | 5/1945 | Kindland | 81/22 |
| 2,451,217 A | | 10/1948 | Heinrich | 81/22 |
| 2,609,914 A | | 7/1952 | Kahlen | 198/391 |
| 2,737,216 A | | 3/1956 | Kenerson | 81/22 |
| 3,088,506 A | | 5/1963 | Bianchini | 81/19 |
| 3,130,762 A | | 4/1964 | Kerr | 81/25 |
| 3,343,576 A | | 9/1967 | Norcross | 81/19 |
| 3,770,033 A | * | 11/1973 | Gavillet et al. | 81/22 |
| 3,796,244 A | | 3/1974 | Florian | 81/26 |
| 3,844,321 A | | 10/1974 | Cook | 81/26 |
| 4,039,012 A | | 8/1977 | Cook | 81/22 |
| 4,433,709 A | | 2/1984 | Porter | 81/26 |
| 4,440,205 A | | 4/1984 | Hillinger | 30/308.1 |
| 5,261,164 A | | 11/1993 | Bellegante | 30/308.1 |
| 5,408,902 A | | 4/1995 | Burnett | 81/22 |
| D362,795 S | * | 10/1995 | Ronnholm | D8/76 |
| 5,960,677 A | | 10/1999 | Carmien | 81/22 |
| 6,128,977 A | | 10/2000 | Gierer et al. | 81/22 |
| 6,234,048 B1 | | 5/2001 | Carmien | 81/22 |
| 6,467,376 B1 | * | 10/2002 | Wu | 81/22 |

FOREIGN PATENT DOCUMENTS

CH 654 784 A5 * 3/1986

* cited by examiner

*Primary Examiner*—Hwei-Siu Payer
(74) *Attorney, Agent, or Firm*—VanOphem & VanOphem, P.C.

(57) ABSTRACT

An axe capable of delivering a relatively intensified impact and reduced recoil compared to prior art axes. The axe includes a head, a handle, a rigid casing, and shock-absorbing particles disposed within a portion of the axe. The head includes a blade end and a blunt end with the handle integrally extending from the blunt end and terminating in a grip portion. The rigid casing extends upwardly from around the grip portion of the handle, extends over a rear portion of the head, and terminates against a portion of the blade end of the head. Shock-absorbing particles are disposed within a chamber that is defined by the casing and the head. Upon impact of the axe with an object, the particles suddenly shift forward to intensify the impact of the axe and to reduce the recoil of the axe.

18 Claims, 3 Drawing Sheets

DEAD-BLOW RECOILLESS AXE

BACKGROUND OF THE INVENTION

1. Field of the Invention

The present invention generally relates to hand-held striking tools. More specifically, this invention is directed to an axe that resists recoil and imparts a more effective force per strike compared to prior art axes to reduce effort of use when the tool is struck against an object.

2. Description of the Related Art

Hand-held striking tools are among the oldest implements known to man. Nonetheless, inventors continually develop useful improvements to these tools that manufacturers continually incorporate into their designs for sale in the marketplace.

Specifically, many attempts have been made to reduce the undesirable effects of striking a tool against a workpiece. For example, over a century ago in U.S. Pat. No. 115,532, James M. Sears taught use of a flexible axe handle to prevent impact shock to the hands and to impart more force to the workpiece. Sears disclosed the axe handle as having a flexible joint consisting of an iron tenon, a wood grip, an iron hook portion screwed along a portion of the wood grip, and a rubber block disposed between the wood grip and iron tenon. The pivot axis of the flexible joint is defined by the hook of the iron hook portion being pivoted around a pivot portion of the iron tenon. The flexible joint is bolstered by a pair of steel side straps flexibly fastened across both the iron tenon portion and wood grip portion. Rivets extend through holes in the side plates and holes in the wood grip portion to immovably fasten the steel side straps to the wood grip portion. In contrast, rivets extend through holes in the side plates and slots in the iron tenon portion to pivotably fasten the steel side straps to the iron tenon portion. The slots are arcuately shaped and thereby permit the iron tenon portion to pivot about the pivot axis. While the Sears design may be effective to absorb shock of an axe strike, it is not clear how such absorption would enable greater impact to be imparted to a workpiece from the axe. Perhaps the absorption characteristic enables or encourages the user to exert more energy in any given swing. It is believed, however, that shock absorption in an axe would, by definition, impart somewhat less force to the workpiece since the energy that is being absorbed by the axe is not being imparted to the workpiece.

In another example, U.S. Pat. No. 1,045,145, E. O. Hubbard taught the use of a hammer having a cushioned head to reduce the shock of impact of the head with a workpiece such that the shock is absorbed and not imparted to a user's hand. Hubbard discloses a hammer head having a hollow body with a rubber cushion disposed therein against which an internal head is positioned. An external head is positioned outside the hollow body and threadably fastens to the internal head. Thus, when the external head is struck against a workpiece the impact is imparted through the internal head and absorbed by the rubber cushion. Again, via absorption principles, the impact force on a workpiece is reduced and not enhanced.

Following the attempts of Sears and Hubbard to reduce impact shock, the prior art has suggested various designs for reducing rebound or recoil of a hammer, commonly referred to today as "dead blow" hammers. One of the earliest attempts, U.S. Pat. No. 2,451,217 to Heinrich, teaches use of an internal reactionary member disposed in the head of a hammer to absorb impact shock. Heinrich disclosed a hand hammer having a handle terminating in a hollow head. The hollow head includes a hollow internally threaded member, and a hollow externally threaded member that is threaded into the hollow internally threaded member, and a slug that is slidably disposed within the collective interior of the hollow head. Upon impact of the hollow head with a workpiece, the slug suddenly shifts in the direction of the strike from a rearward position in the hollow head to a forward position against the inside of one of the hollow members. Accordingly, the sudden shift of the slug tends to resist the force of the rebound and thereby cushions the force sufficiently to preserve all the power of the impact and yet keep the head from bouncing back from the workpiece. In actuality, however, the slug itself tends to bounce back and forth within the hollow head after impact, thereby causing undesirable vibration in the hand tool.

After Heinrich, a multitude of patents issued that addressed the shortcomings thereof. This inventive activity essentially involved replacing the slidable and bounceable slug of Heinrich with small particles. One of the first to do so was U.S. Pat. No. 2,604,914 to Kahlen. Kahlen addressed unsuccessful post-Heinrich efforts to use fine powder within a hollow head of a hammer to reduce hammer recoil and vibration. Kahlen claimed that powdered material tended to pack together within the hollow head thereby leading to undesirable results, and further claimed that using round shot resulted in oscillation after impact. Instead, Kahlen taught using irregularly shaped, rather than round, shot material disposed within a hollow head of a hammer to reduce hammer recoil. Specifically, Kahlen disclosed the hammer having a T-shaped hollow body having one branch of the T fastened to one end of a handle. The opposed ends of the T each have a striking head fastened thereto by way of an intermediate plug member. Between the plug members a chamber is defined for housing the irregularly-shaped shot.

In the mid-1970's, U.S. Pat. Nos. 3,844,321 and 4,039,012 to William H. Cook taught various improvements to the basic Kahlen dead-blow hammer including unitarily casting such a hammer within a polymeric material to solve certain problems including hammer marring, tearing, and sparking as well as the short working life and difficulty in manufacturing such hammers. As a result, Cook disclosed different hammers, each having a handle member terminating in a hollow cylindrical head having a cavity with lead shot disposed therein. The hammers are entirely or predominantly encased within a urethane using molding techniques now well-known in the art of tool manufacture.

Unfortunately, neither Kahlen nor the Cook designs are reasonably capable of splitting wood in an efficient manner. Furthermore, the Kahlen/Cook design has a significant shortcoming. Presumably, and since there are no teachings to the contrary, the hollow head—by itself—represents a relatively light hammer head compared with conventional solid forged hammer heads. It is, therefore, the lead shot that provides the mass with which to strike a workpiece. Thus, even though the ultimate impact force of the hammer may be typical, the initial impact of just the mass of the hollow head is relatively low. Thus, the lead shot may have the effect of reducing recoil of the hammer, but the lead shot does nothing to add extra impact power beyond the conventional mass of a conventional hammer.

More recently, in U.S. Pat. No. 5,261,164, Curtis L. Bellegante taught use of a locking swiveled axe to intensify the impact force of an axe. This invention includes a handle consisting of a main shaft, a swivel shaft, and a releasable latching device disposed therebetween. The main shaft includes a grip end and a connecting end distal the grip end, and the swivel shaft includes a blade attached at a blade end and a connecting end distal the blade end. The releasable latching device is located between the connecting ends of the main and swivel shafts and consists of a ball-lock-pin that enables the pivoting action of the axe and further consists of a spring-loaded latch.

In operation, a user presses the spring-loaded latch to free the swivel shaft from its locked upright position to an angled back position. Then, the axe is swung forward with sufficient force to accelerate the blade whereby the swivel shaft swings to a position aligned with the main shaft just before impact, such that the spring-loaded latch locks up to prevent the blade from reversing momentum upon impact with an object. Unfortunately, the Bellegante axe necessarily includes a collection of unnecessarily complex features including the ball-lock-pin, spring loaded latch, and catch grooves, which require lubrication. Moreover, to ensure that the swivel shaft locks in place just before impact, Bellegante evidently requires a user to adjust his swing from a typical full follow-through swing to a stop-action swing.

From the above, it can be appreciated that impact absorbing and dead-blow hand tools of the prior art are not fully optimized to provide a simpler, less costly hand tool that is truly capable of delivering an intensified impact and resisting impact recoil. Therefore, what is needed is a simple and relatively inexpensive dead-blow axe that delivers a relatively more intense impact and resists recoil upon impact.

BRIEF SUMMARY OF THE INVENTION

According to the preferred embodiment of the present invention, there is provided an axe having a head, a handle, a rigid casing, and a shock-absorbing mass disposed within a portion of the ax. The head includes a blade end and a blunt end, wherein the handle integrally extends away from the blunt end and terminates in a grip portion. The rigid casing covers a portion of either or both of the head and handle, and the shock-absorbing mass is disposed within a chamber that is partially defined by the casing. Upon swinging the axe into impact with an object to be cut by the ax, the shock-absorbing mass suddenly shifts forward under the inertia of the swing to intensify the impact of the axe and to reduce the recoil of the ax.

The present invention is capable of successfully incorporating the benefits of dead-blow functionality into an axe such that improved impact and reduced recoil of the axe is achieved.

It is an object of the present invention to provide an axe having dead-blow functionality such that the recoil of the axe is reduced.

It is another object to provide an axe having such dead-blow characteristics that are enabled using relatively inexpensive design features and using well-known manufacturing processes.

It is still another object to eliminate or reduce the need to use a sledge hammer and wedge combination to split wood.

It is yet another object to achieve improved axe performance with the axe of the present invention compared to prior art axes of comparable size and weight.

These objects and other features, aspects, and advantages of this invention will be more apparent after a reading of the following detailed description, appended claims, and accompanying drawings.

DETAILED DESCRIPTION OF THE PREFERRED EMBODIMENT

A cutting tool in accordance with the present invention is generally shown in the Figures. The term axe as used herein means a cutting tool, whether manual or powered, including axes, hatchets, tomahawks, etc. Furthermore, the term dead-blow is synonymous with the term dead-stroke and is a mechanical term in the art of tool manufacture and tool use that means a strike or blow with a recoilless, nearly recoilless, or reduced recoil type of impact.

Figure 1:
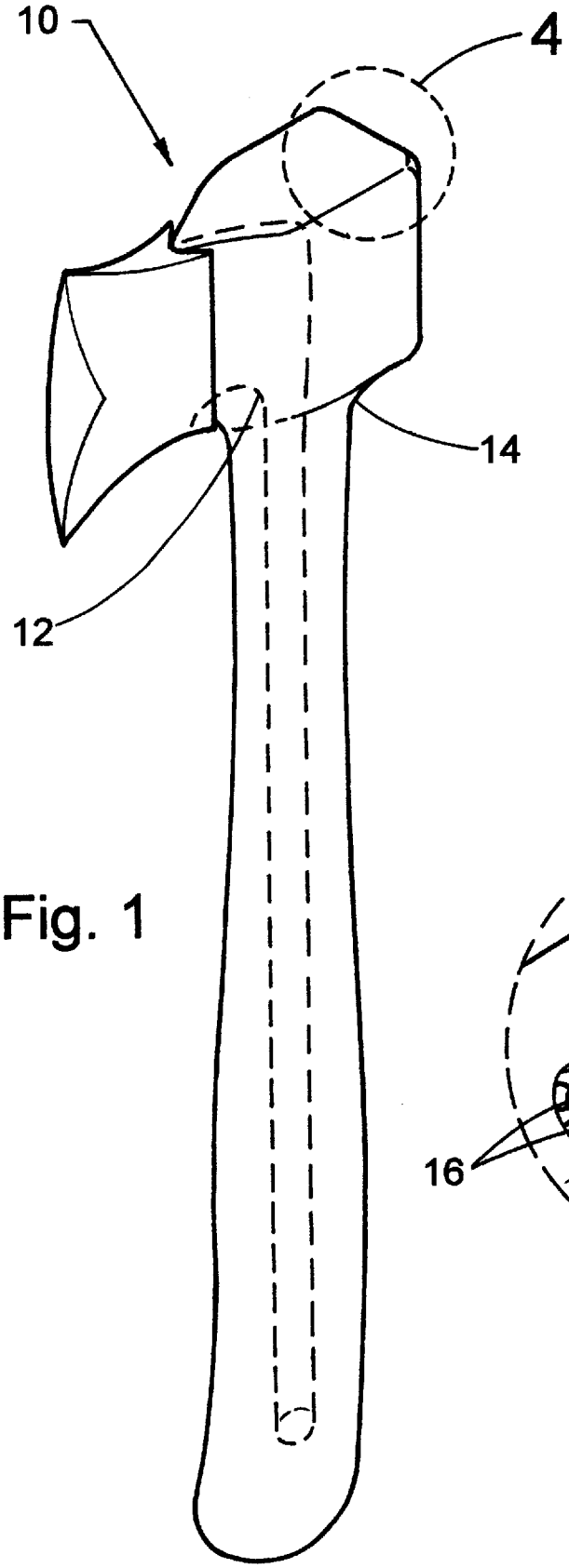
FIG. 1 is a perspective view of an axe according to the preferred embodiment of the present invention.
Figure 4:
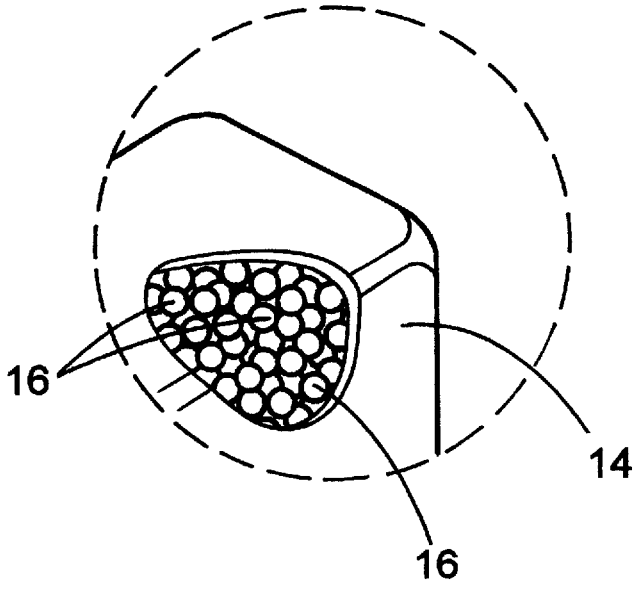
FIG. 4 is an exploded, broken view of a portion of the axe of FIG. 1 illustrating a casing portion partially broken away to show shot particles.

Referring now in detail to the Figures, there is shown perspectively in FIG. 1 an axe 10 according to the preferred embodiment of the present invention. The axe 10 generally includes a skeleton 12, a casing 14, and, as best shown in FIG. 4, a loose mass of particles 16. The axe 10 can be of any size and proportion, such as a full-size tree-clearing axe or merely a hatchet. With respect to prior art axes, the axe 10 of the present invention includes several novel and unobvious features that enable the axe 10 to be particularly more effective in comparison, as will be discussed in detail below.

Figure 2:
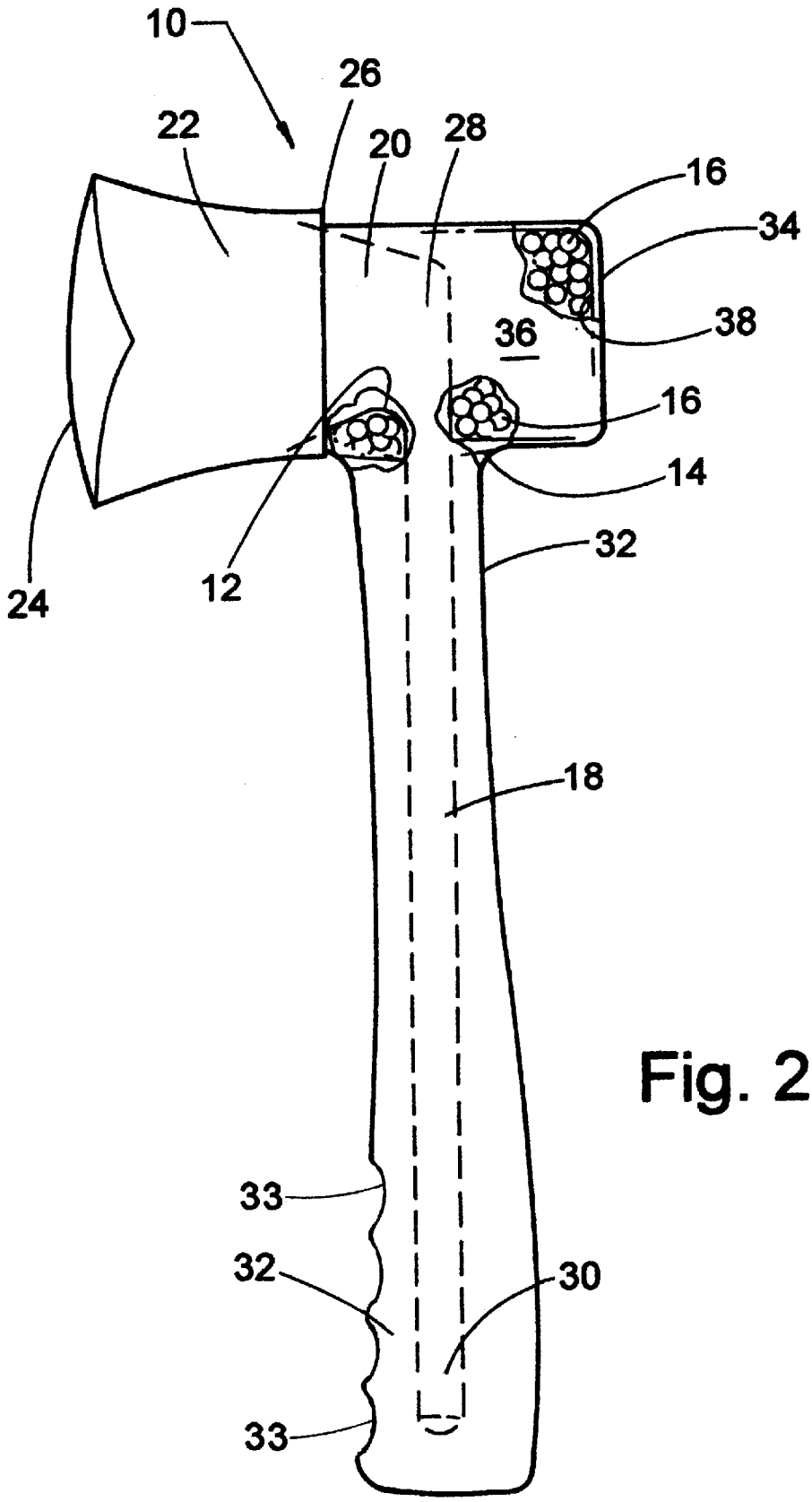
FIG. 2 is a side view of the axe of FIG. 1 illustrating in hidden lines a forged steel alloy axe handle and head, and showing a casing portion partially broken away to show shot particles.

Referring now to FIG. 2, the skeleton 12 includes a handle 18 and head 20 that are integrated into one piece to provide a particularly rigid and robust foundational structure. The skeleton 12 is preferably forged from one mass of metal such as medium carbon steel alloy, so that the skeleton 12 is relatively workable but flame hardenable as well. The production of the skeleton 12 can be carried out using presently known axe forging operations and requires no novel or special techniques. The head 20 includes an arrow-shaped blade 22 defining a blade end or edge 24 extending generally parallel with the handle 18. The blade 22 extends rearwardly from the blade edge 24 and flares outwardly on both sides thereof terminating in barbs 26. The head 20 extends rearwardly from the blade end 24 toward a blunt end 28. The blunt end 28 integrally transitions from the head 20 to the handle 18, such that the handle 18 extends downwardly from the blunt end 28 and terminates in a grip portion 30.

Figure 3:
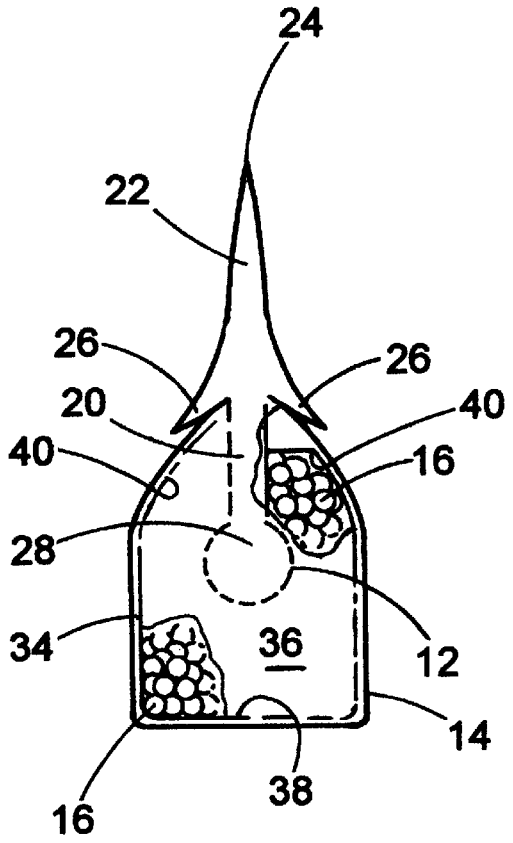
FIG. 3 is a top view of the axe of FIG. 1 illustrating in hidden lines a forged axe head, and showing a casing portion partially broken away to show shot particles.
Figure 5:
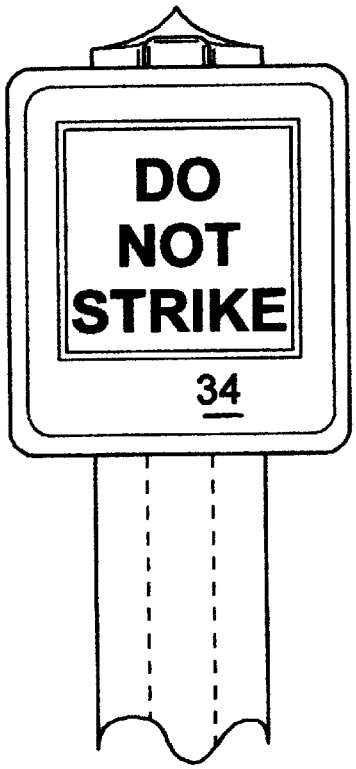
FIG. 5 is an end view of the head of the axe of FIG. 3 with an appropriate legend.

The casing 14 is preferably composed of a fire resistant hard rubber such as a nylon based material. Alternatively, the casing 14 can be composed of a fire resistant plastic such as a modified PC-ABS, or perhaps a vinyl such as is used for electrical wiring. The casing 14 includes a handle portion 32 that preferably surrounds the entire skeleton handle 18 and extends upwardly therefrom. The handle portion 32 preferably includes hand grip contours 33 that are well known in the art. The handle portion 32 integrally transitions into a head portion 34 to enclose the blunt end 28 of the skeleton head 20. As best shown in FIG. 3, the head portion 34 of the casing 14 extends forward from behind the blunt end 28 of the skeleton head 20, converges inwardly, and terminates just behind the barbs 26 of the blade 22. The barbs 26 can alternatively be shaped to closely conform to the shape of the casing 14, if desired. As such, the head portion 34 of the casing 14 is protected behind the barbs 26 against impact with the object upon which the axe is struck. Therefore, split portions of the object being cut will not directly impinge on the casing 14 and thereby damage the casing 14. It is preferred to emboss or imprint the words "Do Not Strike" onto the head portion 34 of the casing 14 to alert the user not to use the axe 10 as a hammer as illustrated in FIG. 5.

Preferably, with referenced to FIG. 2, the handle portion 32 of the casing 14 closely conforms to the entire skeleton handle 18, whereas the head portion 34 loosely encloses a portion of the skeleton head 20 so as to define a void or chamber 36. Alternatively, the handle portion 32 can cover only select portions of the skeleton handle 18 if desired, or can cover only a portion of the skeleton head 20, leaving exposed the skeleton handle 18, or the like.

The chamber 36 is defined preferably between a portion of the casing 14 and a portion of either or both of the head 20 and handle 18 of the skeleton 12. Depending upon the size of the axe 10, the size of the chamber 36 can vary. It is believed however, that the approximate proportions of the chamber 36 to the rest of the axe 10 as shown in the figures, is preferred. As an alternative, the chamber 36 could be a void solely disposed within the material of the casing 14 rather than being bounded by portions of the casing 14 and skeleton 12 as shown in the figures.

The casing 14 is preferably tough, rigid, and composed of a polymeric material such as nylon, polyurethane, polycarbonate or the like. Alternatively, a composite material may be used for the casing 14 so as to provide a relatively soft and flexible material, such as for the handle portion 32 of the casing 14 to optimize hand comfort and a rigid, tough portion for the head portion 34. The casing 14 can either be molded separately from the skeleton 12, or can be molded directly around the skeleton 12, both manufacturing techniques being very well known in the art. In either case, it is preferable and perhaps even necessary to include a closeable access port, like a bunghole (not shown), in the head portion 34 of the casing 14. Such a feature is not shown in the figures but is well known in the art, particularly for blow-molded plastics. A closeable bunghole would provide access to the chamber to permit partially filling the chamber 36 with the mass of particles 16.

The mass of particles 16 is preferably a mass of stainless steel shot that can easily be poured into the chamber 36. Alternatively, the particles 16 can be composed of lead or any other suitable material. The particles 16 are preferably initially round, but can be of any shape or size so long as the particles 16 freely flow within the chamber 36. The particles 16 can be composed of any material other than steel or lead, such as sand, glass, or the like. It is even conceivable that a fluid could also be used in lieu of the particles 16, if so desired. Preferably, the mass of particles 16 occupies less than the complete volume of the chamber 36 such that the particles 16 freely shift within the chamber 36 without binding up.

In use, the axe 10 of the present invention performs better than prior art axes of comparable size and weight. As is usual, a user grips the axe 10, slowly draws the axe 10 rearwardly behind the user's head, and then rapidly swings the axe 10 forward at an object in front of the user.

Uniquely, however, it is possible with the axe 10 of the present invention to strike with greater intensity and less recoil compared to prior art axes of comparable size and weight. As the user draws the axe 10 behind the user's head, the particles 16 begin to shift and gather toward a rearward inside portion 38 of the chamber 36. At the instant that the user changes the direction of the axe 10 to start it forward toward the object to be cut, the particles 16 become packed at the rearward inside portion 38 of the chamber 36 until the user strikes the blade 22 of the axe 10 against the object. When the user strikes the blade 22 of the axe 10 against the object, the blade 22 impacts the object with an impact force, such that an external impact of the axe 10 with the object is created.

As a result, the axe 10 cuts into the object, rapidly slowing the speed of the axe 10. At this instant, an ordinary axe would tend to recoil backwards from the abrupt impact. The axe 10 of the present invention, however, carries further into the cut and resists recoiling since a subsequent, internal impact tends to continue the momentum of the axe blade 22 into the object. This subsequent, internal impact arises under Newton's first law of motion, commonly known as inertia, wherein a body in motion remains in uniform motion in a straight line unless acted upon by an external force. As the axe 10 abruptly decelerates, or more appropriately as the externalities of the axe 10 abruptly decelerate, the particles 16 internally located within the chamber 38 of the axe 10 keep moving forward in the direction of the swing and suddenly collide with a forward inside portion 40 of the head portion 34 of the casing 14, behind the barbs 26 of the blade 22 as shown in FIG. 3. The forward inside portion 40 of the casing is preferably shaped flat so that the particles 16 cannot clump or bind together. In other words, the particles 16 suddenly shift forward thereby creating a subsequent, internal impact to intensify the external impact of the axe against the object and to reduce or resist the recoil of the axe 10 off the object. Thus, the subsequent internal impact that is caused by the particles 16 tends to maintain the momentum of the axe head 20 and counteract recoil, or bouncing back, of the axe head 20.

Thus, the present invention is a significant improvement over axes of the prior art since the impact is intensified and tendency of the axe 10 to recoil is reduced. Therefore, the necessity to use a relatively heavier axe or a sledge and wedge combination is reduced or eliminated.

Such an invention was heretofore not even contemplated for an ax, because of the significant difference in environmental conditions between axes and hammers. In other words, while hammers lend themselves easily to dead-blow technology, axes do not. Whereas hammers tend only to superficially contact the objects upon which they work, axes inherently tear through the objects into which they work thereby subjecting the axe to harsh environmental forces. As such, it was not previously possible to safely and robustly incorporate dead-blow technology into an ax. The present invention, however, provides a robust and safe design that incorporates relatively inexpensive modifications to an axe to achieve dead-blow functionality.

While the present invention has been described in terms of a preferred embodiment, it is apparent that other forms could be adopted by one skilled in the art. In other words, the teachings of the present invention encompass any reasonable substitutions or equivalents of claim limitations. For example, the structure, materials, sizes, and shapes of the individual components could be modified, or substituted with other similar structure, materials, sizes, and shapes. Specific examples include enclosing only the head portion of the axe within the casing such that the handle of the skeleton is exposed, or using a metal casing instead of a polymeric casing. Accordingly, the present invention is not limited to only the embodiments shown and described and the scope of the present invention is to be limited only by the following claims.

What is claimed is:

1. A cutting tool comprising:

a head;

a handle extending from said head;

a casing covering the entirety of said handle and a portion of said head, at least a portion of said casing defining a chamber; and a shock-absorbing mass disposed within said chamber.

2. The cutting tool as claimed in claim 1, wherein said head and said handle are integrally connected.

3. The cutting tool as claimed in 1 wherein said casing is composed of a rigid polymeric material.

4. The cutting tool as claimed in claim 1, wherein said shock-absorbing mass comprises a plurality of particles.

5. The cutting tool as claimed in claim 1, wherein said head comprises an arrowhead-shaped blade having rearwardly extending barbs.

6. The cutting tool as claimed in claim 5, wherein said casing covers a portion of said head and terminates behind said rearwardly extending barbs of said arrowhead-shaped blade.

7. A cutting tool comprising:

a head having a blade end and a blunt end;

a handle extending from a portion of said blunt end of said head and terminating in a grip portion;

a rigid casing covering the entirety of said handle, said rigid casing further covering a portion of said head, at least a portion of said rigid casing defining a chamber; and a shock-absorbing mass disposed within said chamber;

whereby upon an impact of said cutting tool with and object, said shock-absorbing mass shifts to intensify said impact of said cutting tool and to reduce recoil of said cutting tool.

8. The cutting tool as claimed in claim 7, wherein said head and said handle are integrally connected.

9. The cutting tool as claimed in claim 7 wherein said casing is composed of a rigid polymeric material.

10. The cutting tool as claimed in claim 7, wherein said shock-absorbing mass comprises a plurality of particles composed of steel shot.

11. The cutting tool as claimed in claim 7, wherein said head comprises an arrowhead-shaped blade having rearwardly extending barbs.

12. The cutting tool as claimed in claim 11, wherein said casing covers a portion of said head and terminates behind said rearwardly extending barbs of said arrowhead-shaped blade.

13. A cutting tool comprising:

a head having a blade end and a blunt end, said head having an arrowhead-shaped blade extending rearwardly from said blade end and terminating in barbs;

a handle extending from a portion of said blunt end of said head and terminating in a grip portion;

a rigid casing enclosing said grip portion of said handle, said rigid casing extending toward said head and enclosing said blunt end of said head, said rigid casing extending toward said blade end of said head and terminating rearward of said barbs, said rigid casing and a portion of said head defining a chamber; and a plurality of shock-absorbing particles disposed within said chamber;

whereby upon an external impact of said cutting tool with an object, said plurality of shock-absorbing particles shifts forward creating a subsequent internal impact to intensify said external impact of said cutting tool with said object and to reduce the recoil of said cutting tool.

14. The cutting tool as claimed in claim 13, wherein said rigid casing is composed of a polymeric material.

15. The cutting tool as claimed in claim 13, wherein said plurality of shock-absorbing particles is composed of steel shot.

16. The cutting tool as claimed in claim 13, wherein said head and handle are integrally forged from steel alloy.

17. A cutting tool comprising:

a head having an arrowhead-shaped blade, said arrowhead-shaped blade having rearwardly extending barbs;

a handle extending from said head;

a casing covering at least a portion of said head said casing terminating behind said rearwardly extending barbs of said arrowhead-shaped blade, at least a portion of said casing defining a chamber; and a shock-absorbing mass disposed within said chamber.

18. A cutting tool conspiring:

a head comprising an arrowhead-shaped blade having rearwardly extending barbs, said head further comprising:

a blunt end;

a handle extending from a portion of said blunt end of said head, said handle terminating in a grip portion;

a rigid casing covering at least a portion of said head, said casing terminating behind said rearwardly extending barbs of said arrowhead-shaped blade, at least a portion of said rigid casing defining a chamber; and a shock-absorbing mass disposed within said chamber;

whereby upon an impact of said cutting tool with an object, said shock-absorbing mass shifts to intensify said impact of said cutting tool and to reduce recoil of said cutting tool.

* * * * *